US005217072A

United States Patent [19]

Wittrisch

[11] Patent Number: 5,217,072

[45] Date of Patent: Jun. 8, 1993

[54] DEVICE FOR CARRYING OUT INTERVENTIONS IN NONFLOWING DEFLECTED PRODUCING WELLS

[75] Inventor: Christian Wittrisch, Rueil-Malmaison, France

[73] Assignee: Institut Francais du Petrole, Rueil-Malmaison, France

[21] Appl. No.: 787,657

[22] Filed: Nov. 4, 1991

[30] Foreign Application Priority Data

Nov. 2, 1990 [FR] France ..... 90 13692

[51] Int. Cl.[5] ..... E21B 23/10; E21B 47/06

[52] U.S. Cl. ..... 166/250

[58] Field of Search ..... 166/250, 383, 386, 65.1

[56] References Cited

U.S. PATENT DOCUMENTS 4,159,643 7/1979 Watkins ..... 166/250 X
4,729,429 3/1988 Wittrisch ..... 166/383 X
4,940,094 7/1990 Lessi et al. ..... 166/386 X

*Primary Examiner*—William P. Neuder
*Attorney, Agent, or Firm*—Antonelli, Terry, Stout & Kraus

[57] ABSTRACT

The device comprises an intervention tool consisting for example of a pumping assembly (6) and a measuring assembly (8) which are associated with a tubing (7) and taken down into a well. The connection between at least one of the two assemblies and a surface installation is achieved by means of a multicore cable (11) fitted with a delayed-plugging connector (12) and conveyed to said assembly by a fluid current. In order to avoid the undesirable effects which the pumping fluid may have on the measuring instruments or possible circulation impossibilities with certain pumping means, a bypass valve (17) allowing the exhaust of the fluid outside the tubing is installed on the tubing, close to the concerned assembly or to each one of them. This valve is for example a sliding valve, the connector (12) being fitted with means (13) for opening and closing this valve in the translations thereof near the plugging position thereof.

8 Claims, 3 Drawing Sheets

DEVICE FOR CARRYING OUT INTERVENTIONS IN NONFLOWING DEFLECTED PRODUCING WELLS

BACKGROUND OF THE INVENTION

The present invention relates to an improved device for carrying out interventions in deflected nonflowing producing wells, such as an activation of the production and measurings on the effluents produced.

The published French patent application 2,637,939 and the addition certificate No. 89/04,225 describe a device for carrying out interventions in deflected wells achieving an activation of the production and measurings on the multiphase effluents produced. This device is installed at the lower end of a tubing. The connection with a surface control and testing station is achieved by means of a multifunction cable comprising power supply lines and measuring signal transmission lines. The cable ends in a delayed-plugging connector. The connector is introduced into the tubing by a side-entry sub and driven by a fluid current until it connects onto a plug fastened to the intervention device. This layout, which highly facilitates the procedure of setting of the device in the producing zone, has nevertheless a drawback. The pumping of the connector in a strongly deflected part of the tubing compels to inject a large amount of a driving fluid right into the zone of connection to the device, i.e. the producing zone. This fluid, which is brought into the producing zone, distorts the measurements. It is also likely to damage certain instruments such as flowmeters which are designed for treating fluids circulating in the opposite direction towards the outside of the well. This fluid circulation is slowed down or even impossible with certain types of pumps. This is notably the case with positive-displacement pumps with a relatively low output of the Moineau type for example.

French patent application 90/08,270 describes an intervention device of the same type. This device comprises a tubing on which an effluent pumping assembly topping a side-entry sub is inserted, as well as an assembly for measuring the effluents near the lower end of the tubing and at a distance from the pumping assembly which can be great. The measuring assembly is connected with a multicore cable running inside the tubing to the side-entry sub, passing outside and going up to the surface installation. The pumping assembly is electrically powered from the surface installation by a separate connection. It is positioned at a dynamic level where it can be reached by the effluents produced. In this case also, the multicore cable is fitted with a delayed-plugging connector which is conveyed by pumping the fluid to a plug immovably attached to the measuring assembly.

SUMMARY OF THE INVENTION

The improved device according to the invention allows, for all well configurations, to electrically supply an activating and measuring system by means of a cable fitted with a delayed-plugging connector by means of a fluid current, this device being laid out to avoid the possible drawbacks of the prior devices.

The improved device according to the invention allows to carry out interventions in deflected nonflowing producing wells such as a production activation and measurings on the effluents produced. It comprises a tubing connected with a surface installation comprising at least one inserted side-entry sub, means for closing the annular space between the well and the tubing, an intervention assembly comprising means for activating the production of the well and means for measuring at least part of the effluents produced and at least one linking cable connecting the activating means and/or the measuring means with said surface installation, said cable being fitted with a delayed-plugging connector displaceable along the tubing under the action of a fluid current.

The device comprises means for intermittently diverting out of the intervention zone at least part of the fluid current established for driving said connector, the connector being adapted during the displacement thereof for opening or closing said exhaust means.

The diversion means comprise for example at least one valve upstream from the measuring means which connects the inside of the tubing with the annular space between the tubing and the well.

According to an embodiment procedure, this valve is a sliding valve.

In this case, the device can comprise retractable holding means for intermittently making the diversion means interdependent in translation.

The diversion means comprise for example at least one sleeve which can slide within the tubing and near the intervention zone between a backward position where openings provided through the side wall of the tubing are revealed and a forward position where said openings are screened by the sleeve, this sleeve being inwardly fitted with radial extensions, a load part associated with the connector, fitted with bosses adapted for resting against said radial extensions and for pushing said sleeve towards the forward position thereof, and means for intermittently locking the load part in relation to said sleeve.

The device can also comprise means for intermittently locking said sleeve in relation to the wall of the tubing.

Each linking cable is for example a multicore cable comprising power supply lines and lines for transmitting the control and measuring signals.

The device can for example comprise a second cable also fitted with a delayed-plugging connector, which connects the activating means with the surface installation.

The invention also relates to a method for carrying out interventions in deflected nonflowing producing wells such as an activation of the production and measurings on the effluents produced, comprising setting a tubing connected with a surface installation and fitted with at least one inserted side-entry sub, means for closing the annular space between the well and the tubing, an intervention assembly comprising means for activating the production of the well and means for measuring at least part of the effluents produced and at least one linking cable connecting the activating means and/or the measuring means with said surface installation, said cable being fitted with a connector which is displaceable along the tubing under the action of a fluid current, the intervention assembly being adapted for being connected in a delayed way with said plug-in connector.

The method is characterized in that, in order to connect the plug-in connector with the intervention assembly in the well without risking damaging the assembly, be it an activating pump and/or measuring instruments :

a tubing fitted with exhaust means allowing to intermittently connect the inside of said tubing with the outside thereof is used, these exhaust means initially having an open position and being laid out to be actuated by said plug-in connector, and said connector is driven along the tubing by a fluid current established between the inside of the tubing and the outside thereof through the exhaust means, until the connector reaches a position of connection with the intervention assembly and closes said exhaust means.

BRIEF DESCRIPTION OF THE DRAWINGS

Other features and advantages of the device according to the invention will be clear from reading the description hereafter of two embodiment procedures given by way of non limitative examples, with reference to the accompanying drawings in which.

Figure 3:
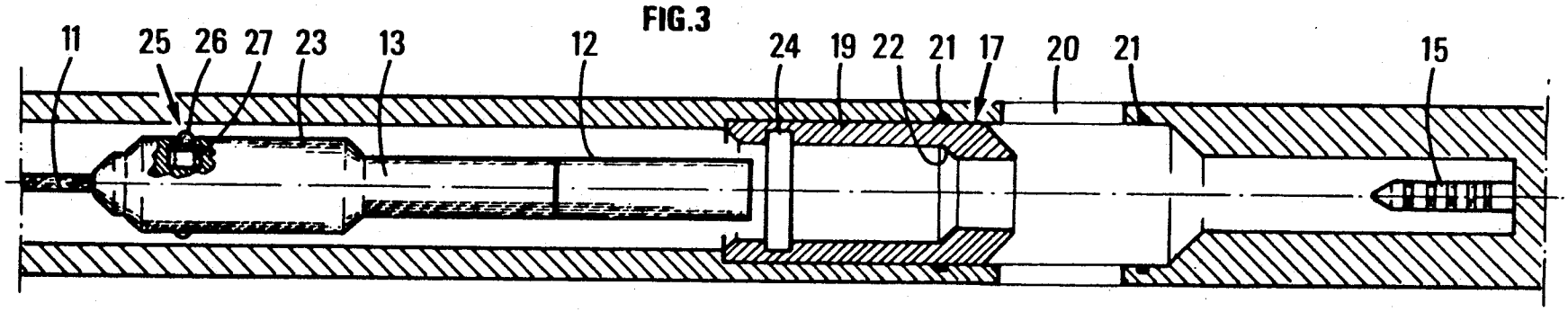
Figure 4:
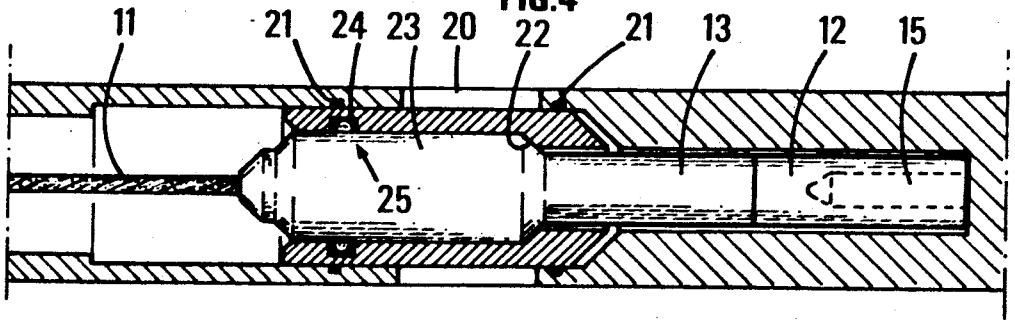
Figure 5:
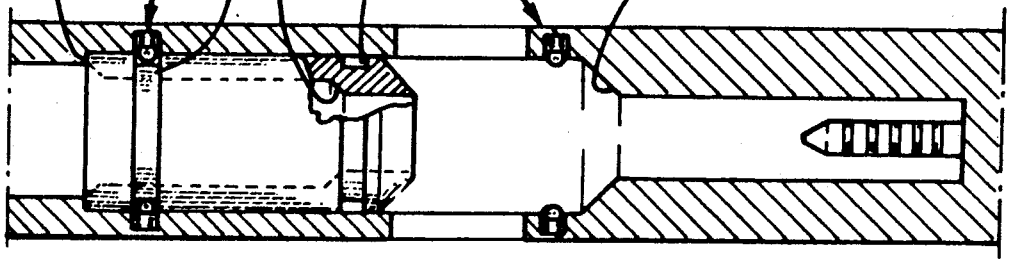

Other features and advantages of the method and the device according to the invention will be clear from reading the description hereafter of embodiment procedures given by way of non limitative examples, with reference to the accompanying drawings in which:

FIG. 3 shows more in detail the zone of connection of the connector and the displaceable valve allowing to divert the driving fluid through the annulus between the tubing and the well, this valve being in an open position, FIG. 4 shows the same zone, the connector having reached the plugging position and having closed said valve, and FIG. 5 shows an embodiment variant with means for locking the valve in the open and in the closed position.

DESCRIPTION OF THE PREFERRED EMBODIMENTS

Figure 1:
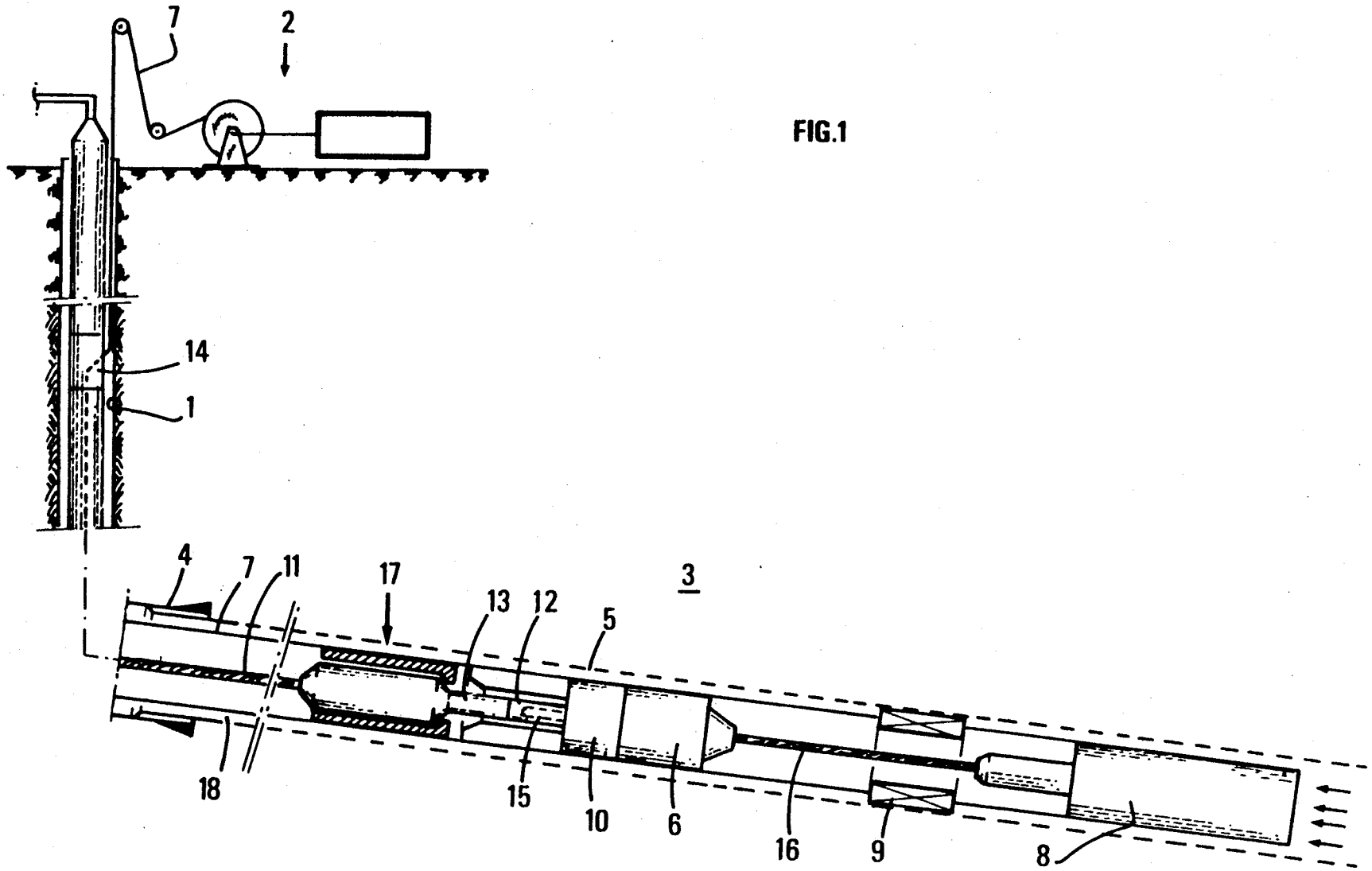
FIG. 1 diagrammatically shows a first procedure of embodiment of the device with a fixed connection between the pumping assembly and the measuring assembly, and FIG. 2 diagrammatically shows a second procedure of embodiment of the device with a delayed-connection link between the same two elements.
Figure 2:
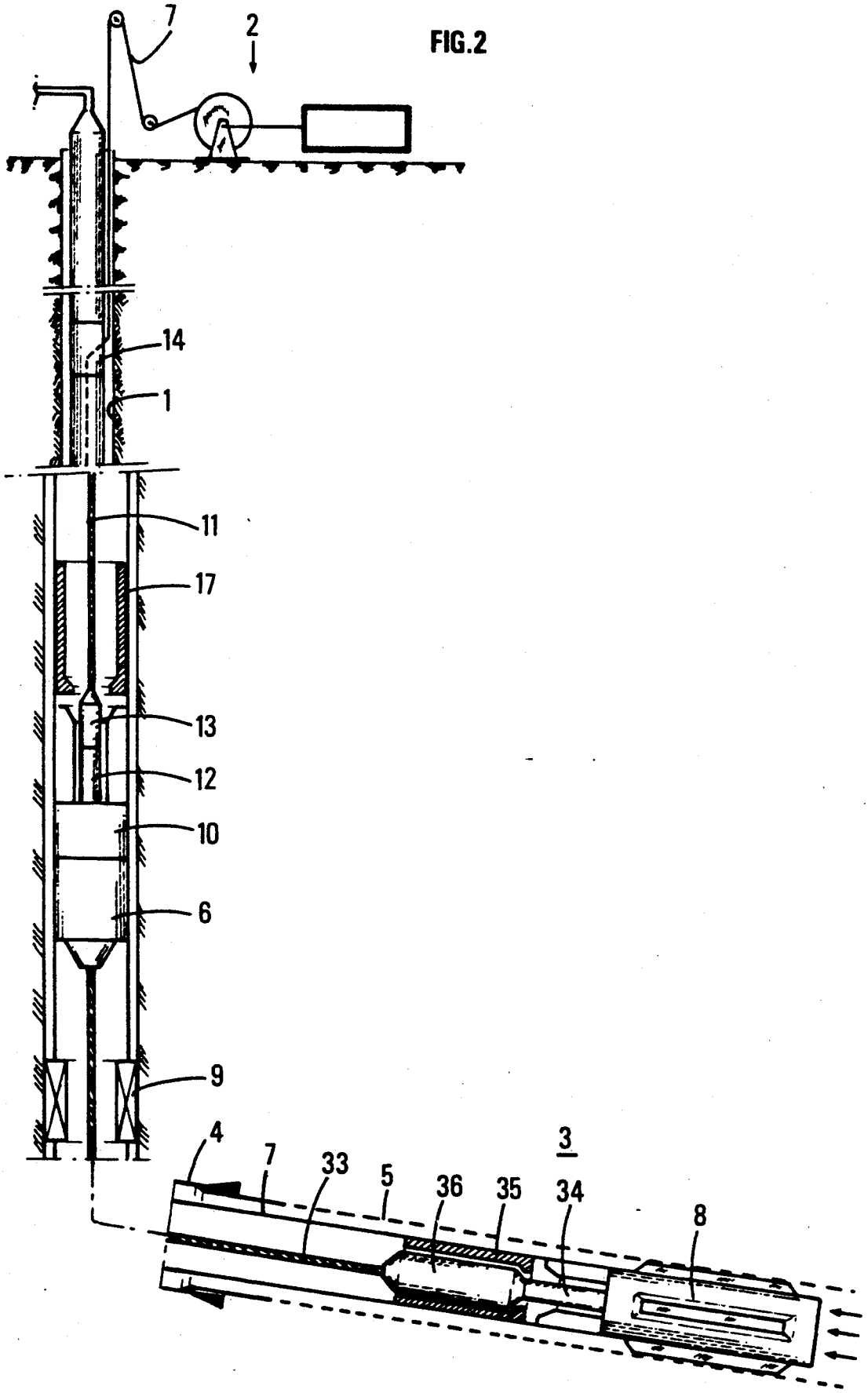

The well 1 shown on FIGS. 1, 2 is drilled from a surface installation 2 down into a petroliferous formation 3. In the lower end thereof crossing a zone producing petroleum effluents, the well 1 is deflected following an angle which is more or less marked in relation to the vertical. It is equipped with a liner 4 with perforations 5 in the part thereof crossing the producing zone. It is a nonflowing well the production of which must be activated by a pumping assembly 6 which can comprise a positive-displacement pump of the Moineau type for example. According to the embodiment procedure of FIG. 1, the pumping assembly 6 is arranged close to the end of a tubing 7. A measuring assembly 8 which can comprise several different instruments for measuring different parameters indicating the production : tracer-ejector, gamma hydrometer, capacitance meter, etc, is arranged at the end of the tubing. A sealing part 9 of a well-known expansible or cup type is arranged for example around the tubing to separate the parts of the well on either side. The effluents coming from the formation flow through the measuring assembly 8 and the tubing 7 and are driven back towards the surface by means of the pumping assembly 6.

This assembly comprises a driving motor 10 electrically powered from the surface installation 2 by a multicore cable 11 comprising supply lines and data transmission lines. The cable 11 ends in a delayed-plugging connector 12 topped by a load bar 13. A connector of this type is for example used in the device described in French patent 2,501,777 (U.S. Pat. No. 4,570,709). The connector 12 is introduced within the tubing through the opening in the wall of a sub 14 of the side-entry type inserted on the drill string constituting the tubing. Such a connector can be displaced through fluid pumping until it is completely plugged in a multicontact plug 15 (FIGS. 1, 3) fastened to the pumping assembly and connected with the electric motor 10 driving the pumping assembly 6. Different electric conductors of a cable 16 linking the pumping assembly to the measuring assembly 8 are also connected with the same plug. Through this cable 16, the measuring assembly 8 is electrically powered and can transmit measuring data.

The device comprises near the pumping assembly a bypass valve 17 adapted, in the open position, for diverting the fluid used for driving the connector 12 and the load bar 13 thereof towards the annular space 18 around the tubing 7. This means avoids any possible disruption of the measuring instruments 8 in case the fluid current can cross the pumping assembly. Besides, this diversion is necessary if a pump 6 of the positive-displacement type such as a MOINEAU pump, which cannot be crossed by the counterflow fluid, is utilized.

This valve is a sliding valve for example. It comprises (FIGS. 3, 4) a sleeve 19 with an outer section substantially equal to the inner section of the tubing 7 which can slide from a backward position where openings 20 in the side wall of the tubing 7 are revealed, at the periphery thereof, to a forward position where these openings are screened by the sleeve. Seal gaskets 21 are arranged in the wall of the tubing on either side of the openings to establish the tightness of valve 17 in the open position. On the inner wall thereof, the sleeve 19 is provided with radial extensions 22 through which the connector 12 can freely pass. The load bar 13 is fitted with outer bosses 23 with a section wider than the section of the radial extensions 22 in order to rest against it when the valve is in the open position (FIG. 3) and when the connector comes close to the plugging position thereof. In the translation thereof towards this plugging position, the load bar drives the sleeve 19 towards the closing position thereof (FIG. 4). The shape and the layout of the elements are selected for the valve to be pushed back until it completely closes (FIG. 4) when the connector is in the plugging position against the plug 15.

The device is also laid out in such a way that the backward motion of the connector disengaging from the plugging position thereof causes the opening of the valve. To that effect, the sleeve 19 is fitted with an inner groove 24 and the load bar comprises housings for one or several locking elements 25. Each element 25 comprises a latch 26 radially pushed by a spring 27 and positioned in order to fit into the groove 24 when the load bar rests on the radial extensions 22. The tension of the springs 27 is sufficient for the or each latch 26 to drive the sleeve when the load bar is pulled backwards by a traction exerted on the cable 7. This tension of the springs is limited, so that the latches disengage from groove 24 when the tensile force exerted on the cable is sufficient, which allows the going back up of the connector.

According to the variant of FIG. 5, the sleeve of the valve is externally fitted with grooves 28, 29. Housings are provided in the inner wall of the tubing on either side of the openings 20, for locking elements 30, 31 analogous to element 26 for example. In the open position of the valve, imposed by a rear stop ring 32 in the inner wall of the tubing, each element 29 locks into groove 28. In the closed position of the same valve, imposed by another stop ring 33, each element 31 fits into groove 29.

With this layout, the temporary diversion of the driving fluid and the closing thereof are respectively and automatically provided by the backward motion of the connector and the reaching an engaging position thereof.

In the embodiment procedure of FIG. 2, the measuring assembly can be relatively distant from the pumping assembly. In this case, the connection operations are simplified in the same way by connecting the two assemblies through a cable 33 fitted with a connector 34 analogous to the connector and by adapting near the measuring assembly 8 the described device with a sliding valve 35 analogous to the valve 19 actuated by the translation motions of the load bar 36 associated with the connector 34.

The previous device can be completed by placing another sliding valve 37 above the pumping assembly in order to also divert outside the tubing the fluid used for displacing the connector towards the engaging position thereof.

I claim:

1. An improved device for carrying out interventions in a deflected nonflowing producing well including activation of the production and measurement of the effluents produced, which comprises tubing located in the well and connected with a surface installation; at least one side-entry sub; means for closing an annular space between the well and the tubing; an intervention assembly comprising means for activating the production of the well and means for measuring at least a part of the effluents produced; at least one linking cable connecting at least one of the activating means and the measuring means with said surface installation, said cable being fitted with a delayed-plugging connector displaceable along the tubing under the action of a fluid current; and diversion means for intermittently diverting at least a part of the fluid current outside of the tubing into said annular space, and away from said intervention assembly, said connector being adapted, during displacement of said connector, to effect opening or closing of said diversion means.

2. A device as claimed in claim 1, wherein the diversion means comprise at least one valve arranged upstream from the measuring means, said valve means placing the inside of the tubing in fluid communication with the annular space located between the tubing and the well and above the means for closing the annular space.

3. A device as claimed in claim 1 or claim 2, wherein the diversion means comprise at least one sliding valve opening through a translation following an axis of the tubing.

4. A device according to claim 3, wherein the diversion means comprise at least one sleeve which can slide within the tubing between a rear position where openings provided through a side wall of the tubing are exposed and a forward position wherein said openings are screened by the sleeve, said sleeve being inwardly fitted with radial extensions, a load part associated with a connector being provided with bosses and adapted for resting against said radial extensions and for pushing said sleeve towards the forward position thereof, and means for intermittently locking the load bar in relation to said sleeve.

5. A device as claimed in claim 3, further comprising means for intermittently locking said sleeve in relation to a wall of tubing.

6. A device as claimed in claim 1, wherein said linking cable comprises a first multicore cable comprising power supply lines and lines for transmitting control and measuring signals.

7. A device as claimed in claim 6, further comprising a second cable also fitted with a delayed-plugging connector that connects the measuring means with the surface installation by means of the first multicore cable.

8. An improved method for carrying out interventions in a deflected nonflowing producing well including activation of the production and measurement of the effluents produced, said method comprising setting a tubing within said well, said tubing being connected with a surface installation and fitted with at least one side-entry sub, means for closing an annular space between the well and the tubing, an intervention assembly including means for activating the production of the well and means for measuring at least a part of the effluents produced, and at least one linking cable connecting at least one of the activating means and the measuring means with said surface installation, said cable being fitted with a connector displaceable along the tubing under the action of a fluid current and the intervention assembly being adapted for being connected in a delayed way with said connector; providing the tubing with a diversion means for intermittently connecting the inside of said tubing with the annular space, said diversion means being initially in an open position and being arranged to be actuated by movement of said connector; and driving said connector along the tubing by establishing a fluid current between the inside of the tubing and the annular space outside the tubing via said diversion means until the connector reaches a position of connection with the intervention assembly and movement of the connector closes said diversion means.

* * * * *